US008585277B2

(12) United States Patent
Grandi et al.

(10) Patent No.: US 8,585,277 B2
(45) Date of Patent: Nov. 19, 2013

(54) HOMOGENIZING VALVE

(75) Inventors: Simone Grandi, Sala Baganza (IT); Silvia Grasselli, Parma (IT)

(73) Assignee: Gea Niro Soavi S.p.A., Parma (IT)

( * ) Notice: Subject to any disclaimer, the term of this patent is extended or adjusted under 35 U.S.C. 154(b) by 880 days.

(21) Appl. No.: 12/739,256

(22) PCT Filed: Apr. 29, 2008

(86) PCT No.: PCT/IB2008/051661
§ 371 (c)(1),
(2), (4) Date: Apr. 22, 2010

(87) PCT Pub. No.: WO2009/053859
PCT Pub. Date: Apr. 30, 2009

(65) Prior Publication Data

US 2010/0296363 A1 Nov. 25, 2010

(30) Foreign Application Priority Data

Oct. 23, 2007 (IT) ..... PR2007A0080

(51) Int. Cl.
*B01F 5/06* (2006.01)

(52) U.S. Cl.
USPC ..... 366/176.2; 138/46

(58) Field of Classification Search
USPC ..... 366/176.2; 138/43, 45, 46
See application file for complete search history.

(56) References Cited

U.S. PATENT DOCUMENTS

| | | | | | |
|---|---|---|---|---|---|
| 1,131,368 | A | * | 3/1915 | Grelck | 138/46 |
| 1,451,393 | A | * | 4/1923 | Hormann | 138/46 |
| 1,507,378 | A | * | 9/1924 | Hormann | 138/46 |
| 1,662,749 | A | * | 3/1928 | Jorgensen | 138/40 |
| 1,763,313 | A | * | 6/1930 | McClatchie | 138/45 |
| 2,264,805 | A | * | 12/1941 | Lowe | 138/46 |
| 4,085,463 | A | | 4/1978 | Wilson | |
| 5,217,037 | A | | 6/1993 | Bristol | |

FOREIGN PATENT DOCUMENTS

| | | | |
|---|---|---|---|
| DE | 37 28 946 | A1 | 3/1989 |
| EP | 0 593 833 | A1 | 4/1994 |
| EP | 0 810 025 | A1 | 12/1997 |
| GB | 476 556 | A | 12/1937 |
| WO | 97/31706 | A1 | 9/1997 |

* cited by examiner

*Primary Examiner* — David Sorkin
(74) *Attorney, Agent, or Firm* — Pearne & Gordon LLP

(57) ABSTRACT

A homogenizer valve (1) comprising a ring-shaped first chamber (5) with an inlet (8) for receiving fluid under high pressure, a second ring-shaped chamber (7) with an outlet (9) for fluid under low pressure, a passage head (10) and, between the first and the second chamber, an impact head (11) which is axially mobile with respect to the passage head (10) and acts together with it to define a gap between the impact head (11) and the passage head (10) forming a passage (14) for the fluid passing from the first chamber to the second chamber, and a pusher (15) acting on the impact head (11) to push it in an axial direction towards the passage head (10) thus partially counteracting the pressure exerted by the fluid contained in the first chamber (5) on the annular surface (13) of the impact head (11), this passage (14) comprising at least a first portion (20) and a second portion (21) positioned in sequence between the first chamber and the second chamber, and where the first portion faces in a radial direction and the second portion faces in a direction with an axial component.

7 Claims, 6 Drawing Sheets

HOMOGENIZING VALVE

TECHNICAL FIELD AND BACKGROUND ART

The present invention relates to a homogenizing valve.

The present invention refers in particular to equipment for homogenizing fluids and in particular liquids containing particles, globules and fibres, that is, products which are substantially liquid but subject to the formation of solid portions or otherwise liquids which have high density (such as milk containing fat globules).

Homogenizing equipment comprises a high-pressure pump and a homogenizing valve with an inlet connected to the delivery port of the pump for receiving pressurized fluid and an outlet for the low-pressure homogenized fluid.

The homogenization obtained in this way consists substantially of breaking up the globules in order to achieve the following objectives:

- to reduce the average size of the globules to the minimum;
- to make the globule size as uniform as possible (or, expressed in statistical terms, to reduce the variance of the amplitude distribution of the of the globules in the product treated).

The fluid is forced through a passage of reduced dimensions, from a first, high-pressure chamber (connected to the pump delivery port) to a second chamber (connected to the valve outlet).

This passage is defined by a passage head forming part of the valve body (and therefore fixed) and an impact head which is mobile axially with respect to the passage head. In effect, the passage consists of a gap between the impact head and the passage head.

The fluid under high pressure in the first chamber presses against the surface of the impact head exerting a pressure on the impact head which tends to widen the passage. The impact head is fitted with a pusher which exerts a force in the axial direction on the impact head in order to counteract the pressure of the fluid.

In this way and by suitably controlling the action of the pusher, it is possible to maintain the width of the passage at a required value which is substantially constant. This force is a function of the values of the operating flow rate and operating pressure of the valve.

The fluid flows through the forced passage from the first to the second chamber losing pressure and, at the same time, accelerating. The acceleration causes fragmentation of the globules in the fluid. An additional, known feature is the fitting of an impact ring in the second chamber designed to intercept the accelerated fluid; the fluid hits the impact ring at high speed thus causing further fragmentation of the globules.

In general it is considered to be good practice to optimise energy use in the homogenization process. The objective here is to obtain, for a particular pressure, the best possible result for homogenizing the fluid in the terms described above.

This is the background to known technical solutions (for example EP810025 by the same applicant) where the first and second chambers have an annular shape such that the high-pressure fluid in the first chamber presses on the impact head on an annular surface of a relatively small size. This has the advantage that it is possible to operate with especially small values of the passage (also known as gap) for a preset amount of energy applied to the equipment. In this way it is possible to drive the fluid at a high speed which is also uniform (that is, applied to the entire volume of fluid processed).

However, this type of technical solution has shortcomings. Not all the globules accelerated actually impact with the impact ring and some of the globules impact with the impact ring at speeds which are too low. Here it should also be noted that not all the fluid globules are accelerated at the same speed. One of the reasons for this is that the width of the passage is not perfectly constant given that the infeed pump has a finite number of pistons with the result that there are oscillations in the volumetric capacity.

WO 97/31706 discloses a homogenizer valve which comprises a pressurized movable valve cone, a valve seat provided with a central flange, a valve housing, and a wear ring. A recess is present between the flange and the wear ring and so the passage for the fluid may have some drawbacks. U.S. Pat. No. 5,217,037 and EP-A-0593833 (this document refers to a previous patent application of the same Applicant) relate to homogenizing valves having the same drawbacks of the prior art.

DISCLOSURE OF THE INVENTION

The purpose of the present invention is to overcome the drawbacks described above by providing a homogenizing valve that is particularly efficient which, in other words, effectively reduces the size of the globules contained in the fluid to be homogenized while also ensuring uniformity in globule size.

This purpose is fully achieved by the valve described in the present invention and characterised in the claims below.

BRIEF DESCRIPTION OF DRAWINGS

Further features and advantages of the invention will become apparent from the description of an embodiment which follows with reference to the annexed drawings, given purely by way of a non-limiting example, in which.

BEST MODE FOR CARRYING OUT THE INVENTION

Figure 1:
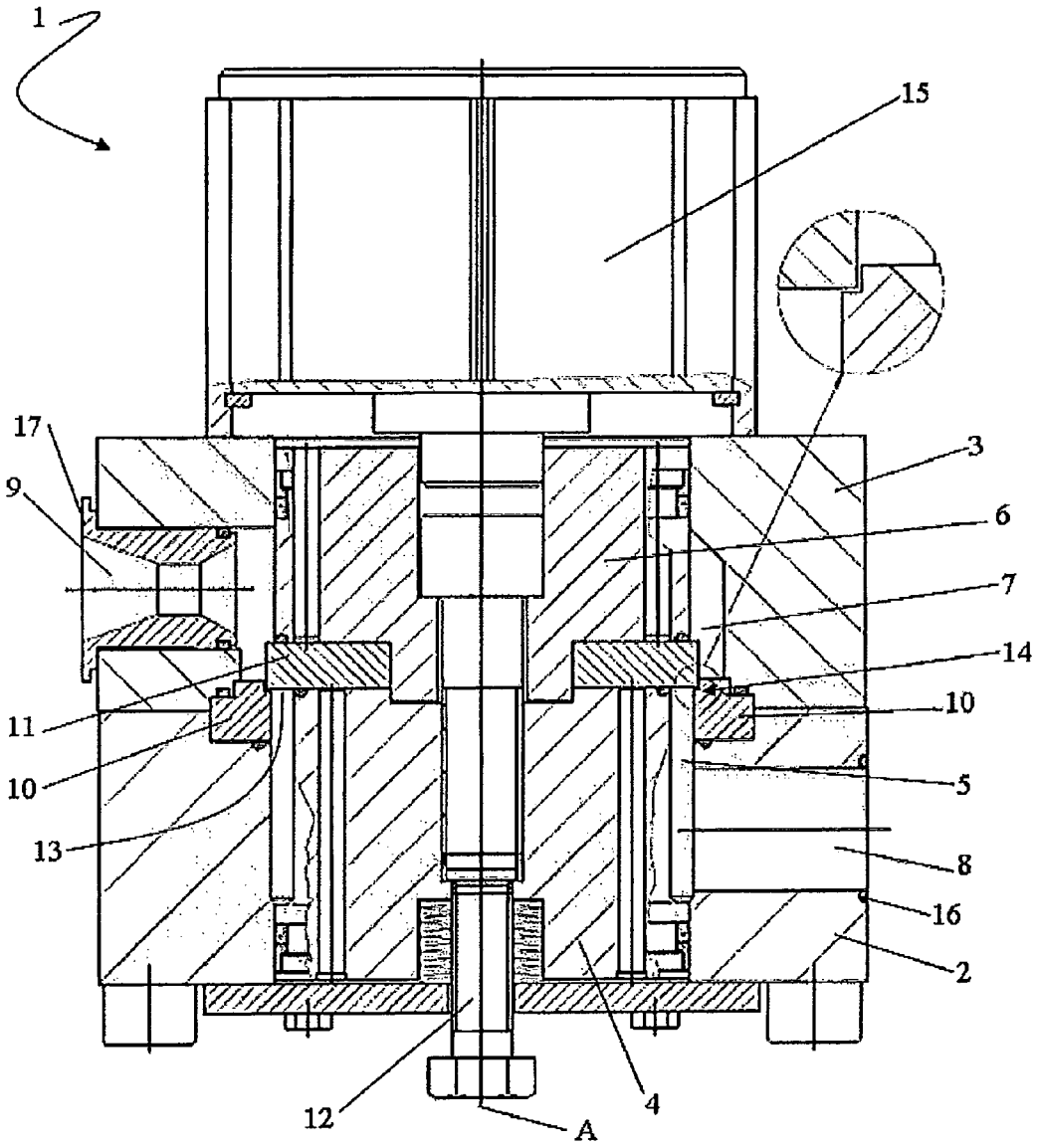
FIG. 1 shows a cross-section of a valve according to the present invention.

In the figures, the numeral 1 indicates a homogenizer valve according to the present invention.

The valve 1 is a homogenizing valve for the treatment of fluid products and in particular of liquids.

The valve 1 is rotation-symmetrical with a longitudinal axis A. The valve comprises a lower valve body 2 and an upper valve body 3 which are axially aligned.

Inside a hole in the lower valve body 2 there is a lower piston 4 inserted in such a way as to define a first chamber 5 which has a ring shape. The first chamber 5 extends lengthways and has a thickness defined by the difference between the radius of the hole in the lower valve body 2 and the radius of the lower piston 4.

Inside a hole in the upper valve body 3 there is an upper piston 6 inserted in such a way as to define between the upper valve body 3 and the upper piston 6 a second chamber 7 which has a ring shape. The second chamber 7 extends lengthways and has a thickness defined by the difference between the radius of the hole in the upper valve 3 and the radius of the upper piston 6.

In the preferred embodiment shown, the lower piston 4 has a radius which is smaller than that of the upper piston 6; the hole in the lower valve body 2 has a radius which is smaller than that of the hole in the upper valve body 3. Thus the second chamber is positioned above and substantially outside the first chamber.

The lower valve body 2 radially defines an inlet 8 for the high-pressure fluid. The inlet 8 can be connected to the pump which together with the valve 1 comprises the homogenizing equipment.

The upper valve body 3 radially defines an outlet 9 for the low pressure fluid treated.

The valve 1 comprises a passage head 10 attached to the lower valve body 2. The passage head 10 is located between the first, high-pressure chamber 5 and the second, low-pressure chamber 7 and is substantially annular in shape.

In addition, the valve 1 comprises an impact head 11 attached to the upper piston 6 and to the lower piston 4 by means of a screw 12. In a preferred embodiment, the impact head 11 is also located between the first, high-pressure chamber 5 and the second, low-pressure chamber 7 and is substantially annular in shape.

The impact head 11 defines an annular surface 13 in contact with the fluid of the first chamber 5 and is located on a transverse plane and is, in other words, perpendicular to the axis A of the valve 1.

The impact head 11 together with the passage head 10 define a passage 14 for the fluid passing from the first chamber 5 to the second chamber 7. The passage 14 consists of a gap between the impact head 11 and the passage head 10.

The impact head 11 is axially mobile with respect to the passage head 10; the impact head 11 is mobile moving together with the lower piston 4, the upper piston 6 and the screw 12 and forms an assembly with these.

The valve 1 also comprises a pusher 15 (consisting, for example, of a pneumatic cylinder) acting on the upper piston 7 to push the assembly (comprising the lower piston 4, the upper piston 6 and the screw 12) in an axial direction.

The pusher 15 acts on the impact head 11 and pushes it in an axial direction towards the passage head 10, thus partially counteracting the pressure exerted by the fluid contained in the first chamber 5 on the annular surface 13 of the impact head 11.

In practice, the flow of treated fluid (pressurized by the pump mounted upstream from the valve 1) enters the first chamber 5 horizontally through the cylindrical hole defining the inlet 8.

It should be noted that the valve 1 comprises a gasket 16 inserted in a seat made in the first chamber 5 and therefore located on the interface between the first chamber 5 and the pump.

The flow of fluid continues in a vertical direction inside the volume of the first chamber 5.

The flow undergoes the process of homogenization (that is, micronization) in the passage 14 in the gap between the passage head 10 and the impact head 11. The impact head 11 is positioned at a prefixed distance (known as a gap) from the passage head 10 (which is fixed); this gap dynamically determines the combination or balance between the homogenizing pressure (that is, the force applied by the pusher 15 to the impact head 11 as it approaches the passage head) and the volumetric flow passing through the valve 1 (which, in turn, determines the thrust that the impact head 11 receives from the fluid contained in the first chamber 5 as it moves away from the passage head 10 in an upwards direction).

The flow of treated fluid continues, is collected in the volume of the second chamber 7 and then exits radially through the outlet 9.

In a preferred embodiment, inside the horizontal hole of the outlet 9 of the second chamber 7 there is a counterpressure nozzle 17 whose purpose is to generate, by means of a throttle of a calibrated section, a counterpressure which is defined on the basis of the maximum volumetric capacity of the valve 1.

It should be noted that the passage 14 connecting the first chamber 5 to the second chamber 7 has an inlet 18 at the first chamber 5 and an outlet 19 at the second chamber 7.

At the inlet 18 the pressure of the fluid drops from the high value present in the first chamber 5 to a low value present in the second chamber 7. This change in pressure accelerates the fluid which reaches a very high speed inside the passage 14.

The passage 14 comprises, initially, a first portion 20 and a second portion 21 arranged in sequence between the inlet 18 and the outlet 19, that is, between the first and the second chamber (i.e. arranged in succession one after the other, from the first chamber 5 to the second chamber 7).

The first portion 20 of the passage 14 is arranged in a radial direction and has a ring shape; therefore the interface between the impact head 11 and the passage head 10 defining the first portion 20 of the passage 14 is located on plane which is substantially perpendicular to the axis A of the valve 1.

The second portion 21 of the passage 14 is originally arranged in at least one direction having an axial component; therefore the passage 14 is shaped so that it undergoes at least one deviation between the first portion 20 and the second portion 21 of the passage 14.

This feature has the advantage that it conveys the fluid at a high speed into a particularly limited volume forcing the globules present in the fluid to impact with the walls of the interface defining the passage 14 at a high speed. This technical feature fulfils the purpose of optimising the homogenizing process.

The action of accelerating the fluid inside the gap defining the deviation generates turbulence inside the fluid so that all the globules tend to impact with the walls of the passage 14 at sufficient speed to produce fragmentation. In this way, the distribution of the amplitudes of the globules of the fluid treated have a particularly low average value and a particularly low variance; this means that all the globules present in the second chamber 7 have amplitude values which are similar and have a low average amplitude.

The applicant has performed research consisting of experiments and simulations which have led to the identification of the suitable preferred features regarding the shape of the passage 14, the impact head 11 and the passage head 10 and where the purpose of these characteristics is to optimise the use of energy in the homogenization process.

In a preferred embodiment the thickness of the second portion 21 of the passage 14 is less than 1 mm. In a further improved embodiment the thickness of the second portion of the passage is approximately 0.5 mm.

The thickness of the passage 14 here is understood as the distance between the facing surfaces of the impact head 11 and the passage head 10 defining the passage 14.

In a preferred embodiment the second portion 21 of the passage 14 extends axially by at least 2 mm. In a further improved embodiment, the second portion 21 of the passage 14 has an axial extension of approximately 3 to 5 mm.

On the other hand, the first portion 20 of the passage 14 preferably has a thickness between 0.08 and 0.17 mm (or approximately 0.15 mm in a further improved embodiment) and extends radially by between 0.7 and 1.5 mm or, in a further improved embodiment, by approximately 1 mm.

The present invention also comprises, by way of example, three different embodiments with respect to the shape of the passage 14.

Figure 4:
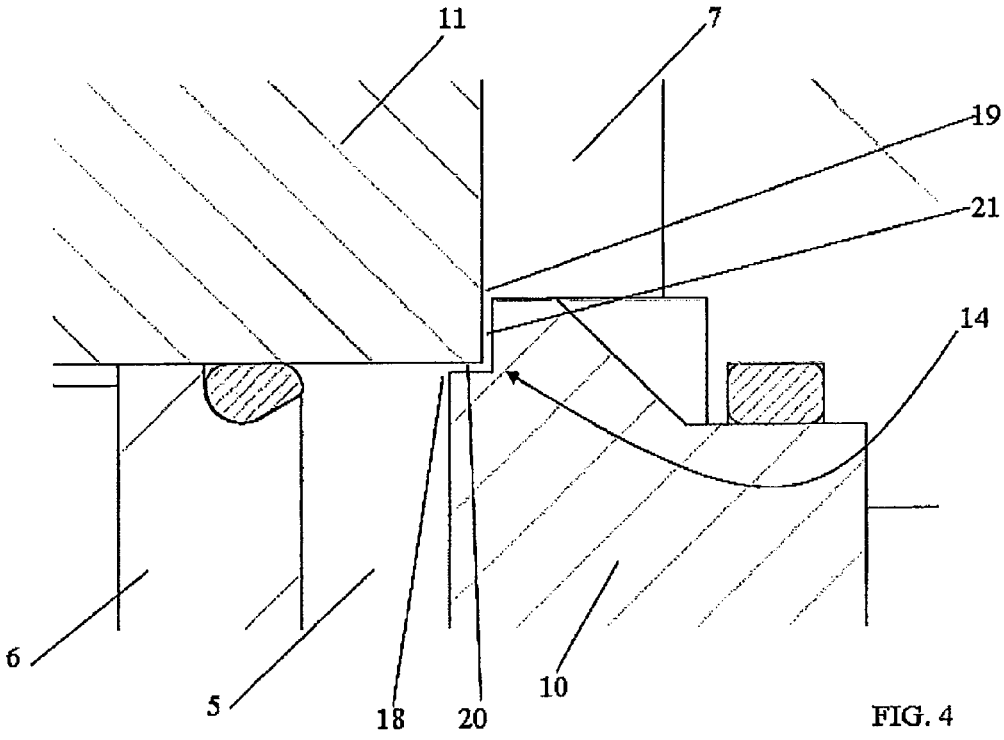
FIG. 4 shows an enlarged detail of part A in FIG. 1.

The first embodiment (shown in FIGS. 1 and 4) has the following characteristics.

The second portion 21 of the passage 14 extends in an axial direction along a cylindrical surface. Therefore, the first portion 20 and the second portion 21 of the passage 14 substantially form a right angle.

In addition, the second portion 21 of the passage 14 is thicker than the first portion 20 of the passage 14; preferably, the second portion 21 is approximately four times thicker than the first portion 20.

Figure 2:
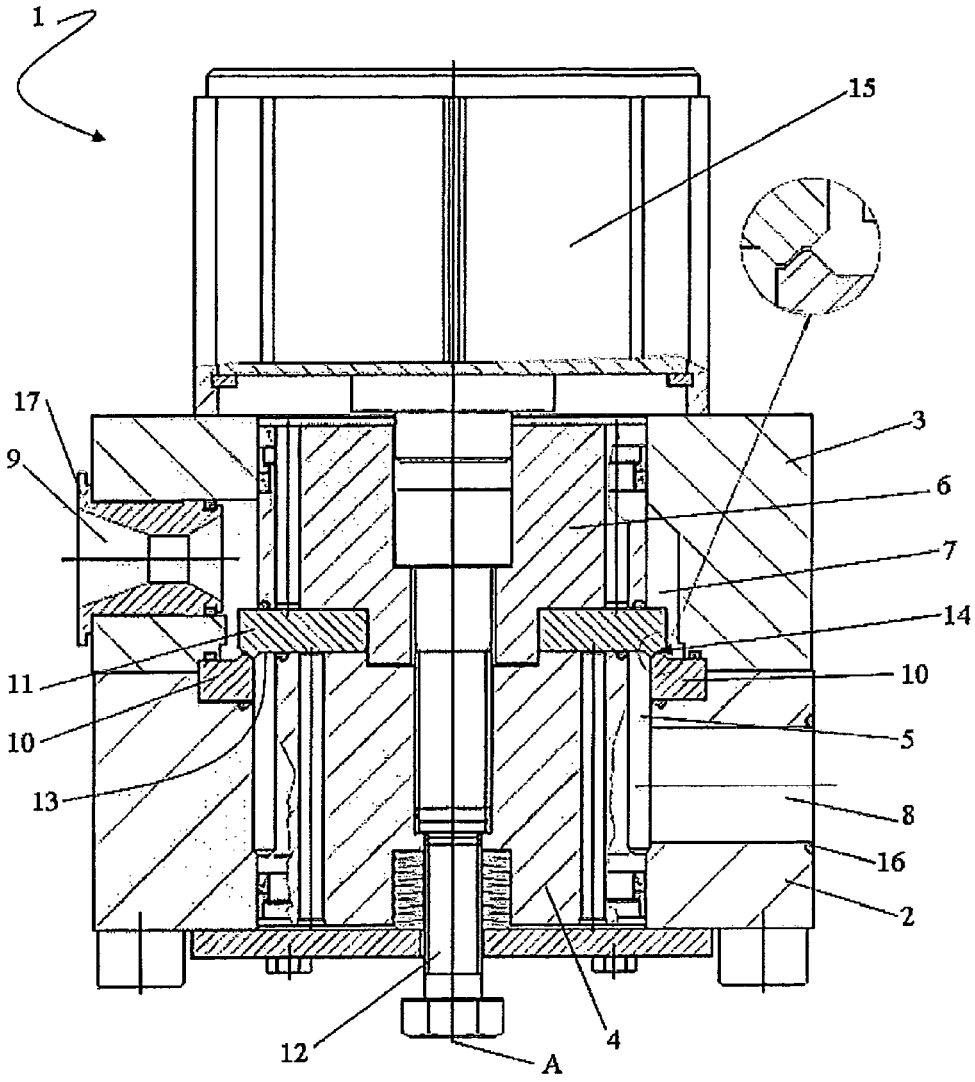
FIG. 2 shows another embodiment of the valve shown in FIG. 1.
Figure 5:
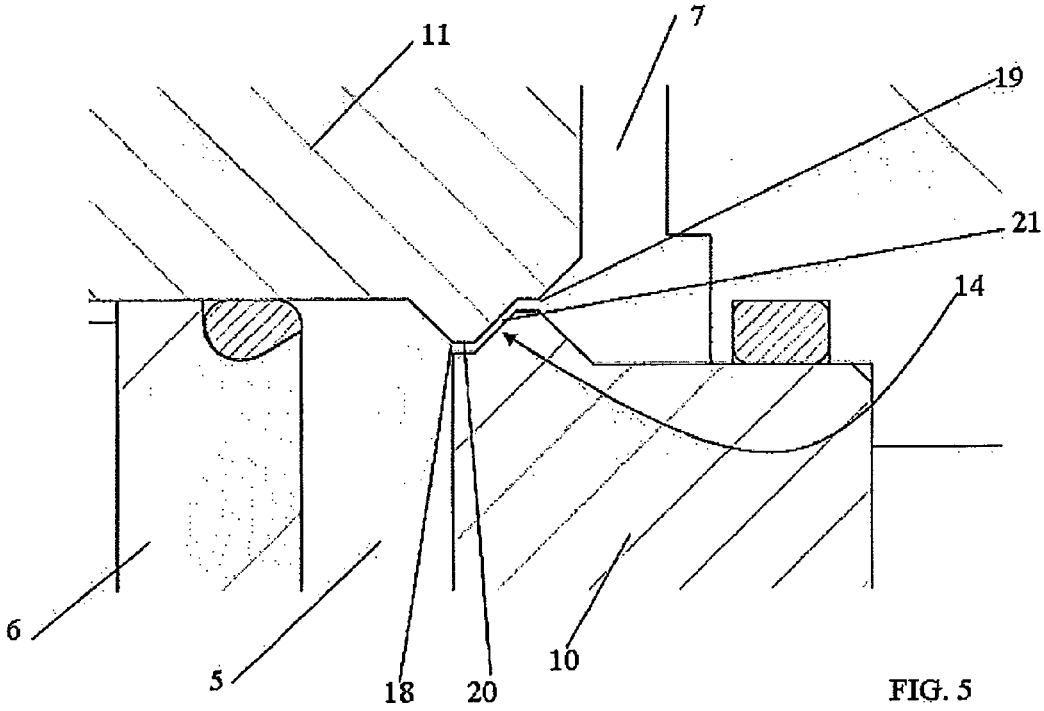
FIG. 5 shows an enlarged detail of part A in FIG. 2.

The second embodiment (shown in FIGS. 2 and 5) has the following characteristics.

The second portion 21 of the passage 14 partially extends in an oblique direction along a conical surface. Preferably, this oblique direction is at an angle of approximately 45 degrees to the axis A of the valve 1. This means that the first portion 20 and the second portion 21 of the passage 14 substantially form an angle of 45 degrees.

The second portion 21 of the passage 14 comprises a first, angled section and a second section (at the outlet 19 of the passage 14) positioned radially and substantially mirroring the first portion 20 of the passage 14. The passage 14 therefore defines a first and a second deviation each of approximately 45 degrees.

In this embodiment the second portion 21 of the passage 14 has substantially the same thickness as the first portion 20 of the passage 14.

It should be noted that in the second embodiment the thickness along the entire length of the passage 14 is determined by the balance between the pressure of the fluid in the first chamber 5 and the force applied by the pusher 15.

Figure 3:
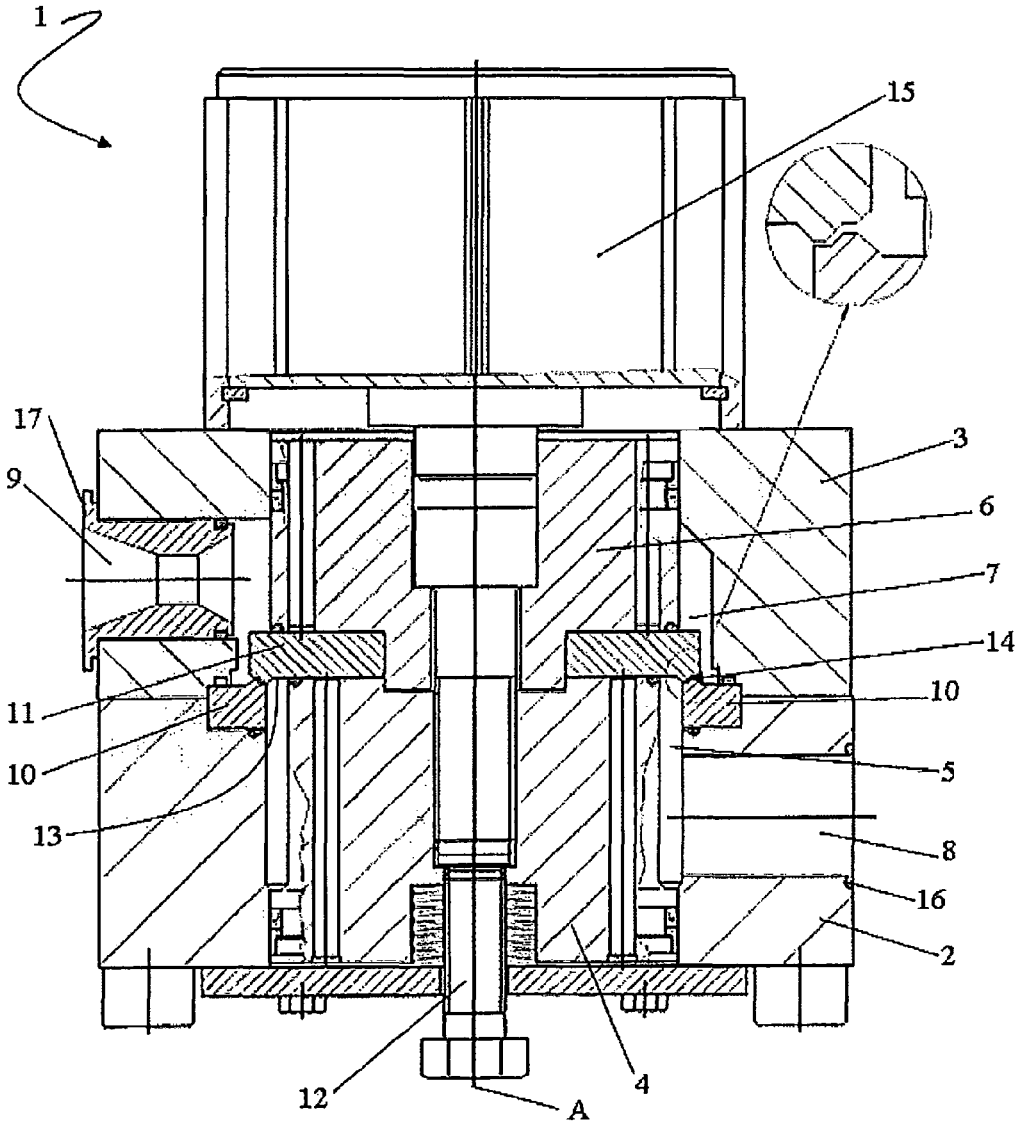
FIG. 3 shows a further embodiment of the valve shown in FIG. 1.
Figure 6:
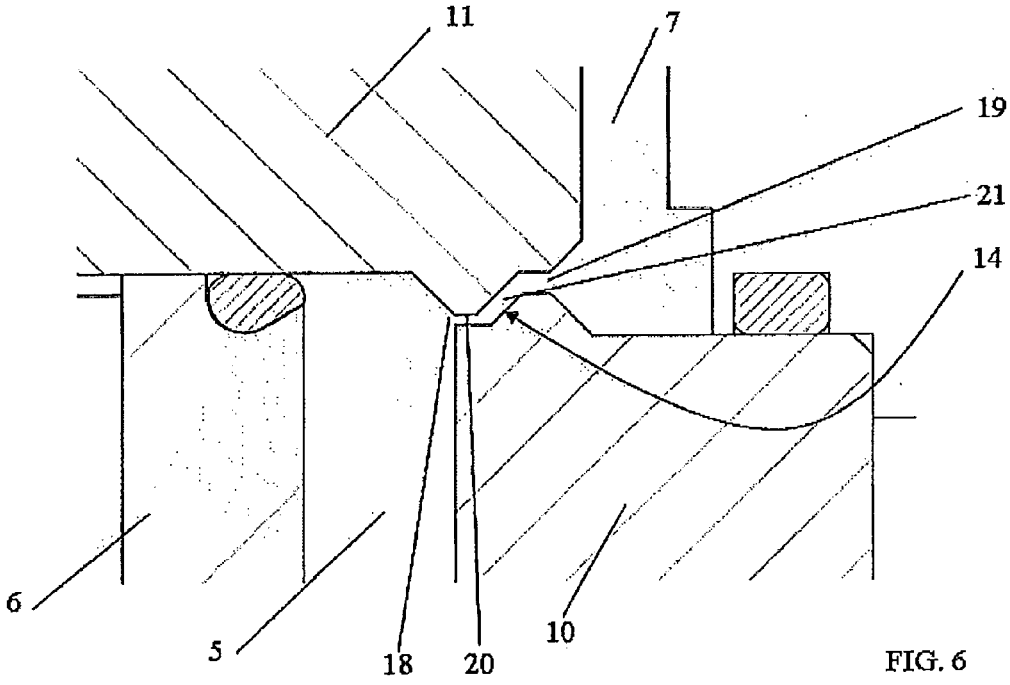
FIG. 6 shows an enlarged detail of part A in FIG. 3.

The third shape (shown in FIGS. 3 and 6) differs from the second shape in that the second portion 21 of the passage 14 is thicker than the first portion 20 of the passage 14; in a preferred embodiment the second portion 21 is approximately four times thicker than the first portion 20.

The present invention has the advantage that it enables the achievement of particularly significant results for a homogenizer valve 1 operating at flow rates of approximately 20000 to 50000 l/h at pressure values of approximately 150 bar in the first chamber 5. For example, the fluid inside the passage 14 has a speed of approximately 100 to 150 m/s; the fluid initially impacts the walls of the passage 14 (due to the fact that the passage 14 has at least one deviation inside it) at a high speed of approximately 100 m/s.

It should be noted that the homogenizer valve 1, originally, is lacking in impact rings or other elements positioned in the second chamber 7 in order to intercept the fluid leaving the passage 14. The second chamber 7 is originally shaped to minimize the presence of dead spots, that is, those recesses or spaces where the fluid would tend to stagnate.

This feature has the advantage that it prevents the fragmented globules from the homogenization process from reforming in the dead spots of the second chamber 7.

The invention claimed is:

1. Homogenizing valve (1) comprising:

a first chamber (5), ring-shaped with an inlet (8) for receiving fluid under high pressure;

a second chamber (7), ring-shaped with an outlet (9) for fluid under low pressure;

a passage head (10), ring-shaped and positioned between the first chamber and the second chamber;

an impact head (11) which is axially mobile with respect to the passage head (10) and cooperates with it to define a gap between the impact head (11) and the passage head (10) forming a passage (14) for the fluid passing from the first chamber to the second chamber, the passage (14) having an inlet (18) and an outlet (19);

a pusher (15) acting on the impact head (11) to push it in an axial direction towards the passage head (10) thus partially counteracting the pressure exerted by the fluid contained in the first chamber (5) on the annular surface (13) of the impact head (11), characterised in that the passage (14) comprises at least one first portion (20) and a second portion (21) positioned in sequence between the first chamber and the second chamber, the first portion being arranged in a radial direction and the second portion being arranged in a direction having an axial component, and in that the second portion (21) has a thickness less than 1 mm and an axial extension of at least 2 mm, said thickness being defined as the distance between the facing surfaces of the impact head (11) and the passage head (10) defining the gap, and in that the passage (14) is shaped in such a way as it does not include dead spots or recesses or stagnating spaces along the passage (14), the passage (14) being without recesses oriented away from the outlet (19) or from the second chamber (7).

2. Homogenizing valve according to claim 1 wherein the second portion (21) of the passage (14) is thicker than the first portion (20) of the passage (14).

3. Homogenizing valve according to claim 1 wherein the second portion (21) of the passage (14) extends in an axial direction along a cylindrical surface.

4. Homogenizing valve according to claim 1 wherein the second portion (21) of the passage (14) partially extends in an oblique direction along a conical surface.

5. Homogenizing valve according to claim 1 wherein the thickness of the second portion (21) of the passage (14) is 0.5 mm.

6. Homogenizing valve according to claim 1 wherein the second portion (21) of the passage (14) has an axial extension of 3-5 mm.

7. Homogenizing valve according to claim 4 wherein the oblique direction is at an angle of 45 degrees to an axis (A) of the valve.

* * * * *